United States Patent [19]

Davis

[11] Patent Number: 5,022,342

[45] Date of Patent: Jun. 11, 1991

[54] BOOKMARK APPARATUS

[76] Inventor: Alton B. Davis, 413 S. 9th St., Klamath Falls, Oreg. 97601

[21] Appl. No.: 565,971

[22] Filed: Aug. 13, 1990

[51] Int. Cl.[5] ..... B42D 9/00

[52] U.S. Cl. ..... 116/236; 116/238

[58] Field of Search ..... 116/234–240; 281/42

[56] References Cited

U.S. PATENT DOCUMENTS

| | | | |
|---|---|---|---|
| 139,936 | 6/1873 | Ward et al. | 116/235 |
| 785,215 | 3/1905 | Hill | 116/238 |
| 838,386 | 12/1906 | Crouch | 116/234 |
| 922,110 | 5/1909 | Eberle | 116/238 |
| 1,974,667 | 9/1934 | Solinger | 116/234 |
| 3,670,691 | 6/1972 | Anderson | 116/237 |
| 4,838,198 | 6/1989 | Knox | 116/239 |

FOREIGN PATENT DOCUMENTS

| | | | |
|---|---|---|---|
| 941532 | 1/1949 | France | 116/239 |
| 6084 | of 1901 | United Kingdom | 116/237 |
| 16885 | of 1904 | United Kingdom | 281/42 |
| 226439 | 12/1924 | United Kingdom | 116/239 |
| 2150077 | 6/1985 | United Kingdom | 116/234 |

*Primary Examiner*—William A. Cuchlinski, Jr.
*Assistant Examiner*—W. Morris Worth
*Attorney, Agent, or Firm*—Douglas E. White

[57] ABSTRACT

A bookmark includes a plurality of strings; two moveable place markers on each string; at least one moveable reference marker bead on each string; and anchor means interconnected with the strings for securing the strings to the book. The anchor means may comprise either a spring clamp for grasping the spine of a book or VELCRO-type hook and loop fastener material for adhering to the book spine.

9 Claims, 1 Drawing Sheet

BOOKMARK APPARATUS

FIELD OF THE INVENTION

This invention relates to bookmarks, more particularly to a bookmark apparatus having means for marking portions of text on a page and means for signaling the content of the marked page.

BACKGROUND OF THE INVENTION

The basic purpose of a bookmark is to mark the page at which the reader last left off reading. Most bookmarks serve this purpose admirably, at least to the extent of narrowing the choice down to two pages (i.e. the left-hand and the right-hand, when the book lies open at the marker).

There is a need, however, particularly among students and other readers of complex literature, to mark not only the particular page, but also the particular passage of text on that page to which the reader later wishes to return. The reader may wish to find this precise passage because that is where he or she last left off reading or because the passage contains material to which easy access for later reference is desired. In the latter case, more than one passage may need to be marked.

There is also a need to reference or signal the general subject matter of marked passages, which reference may be interpreted while the book lies closed.

Conventional bookmarks are inadequate to serve these additional needs of discerning readers.

Prior developments in this field may be generally illustrated by reference to the following patents:

| Patent No. | Patentee | Issue Date |
|---|---|---|
| 3,011,471 | J. C. Tam | 12/05/61 |
| 3,898,951 | G. M. Clare | 08/12/75 |
| 4,574,727 | R. P. Martin, Jr. | 03/11/86 |
| 2,591,094 | J. O'Neill | 04/01/52 |
| 1,322,796 | M. J. Kissel | 11/25/19 |
| 4,507,830 | I. Dahan | 04/02/85 |
| 4,505,219 | M. G. Mangano | 03/19/85 |

U.S. Pat. No. 3,898,951 teaches a bookmark in which hook and loop fastener material, such as that sold under the trademark VELCRO, is used.

U.S. Pat. Nos. 2,591,094, 4,574,727 and 3,011,471 teach bookmarks which adhere to the book spine, wherein the bookmark is looped over the page.

U.S. Pat. No. 1,322,796 teaches a bookmark which has tips on the ends of two strings.

U.S. Pat. No. 4,507,830, while not really a bookmark, is classified with the bookmark art. It shows a string with non-moveable (col. 2, line 67) beads that can be used to retain sheet material, such as maps.

SUMMARY OF THE INVENTION

The present invention is bookmark which comprises a string (or "queue") which has at least two ring beads or planar flags (place markers or "cues") slideably attached. A spine anchor is attached at the top of the string. The anchor may be a piece of VELCRO type hook and loop fastener material that affixes to a matching piece of VELCRO glued to the outside spine of the book. Alternatively, in the case of hard cover books (wherein the spine is loose),-the anchor may be a spring clamp that grasps the spine. As another alternative, the anchor may simply be a flat plastic or paper member which can be looped over and inserted between pages of the book other than those which are marked.

One's last position on a page, or other passage of text to be stored for recall, is marked as follows. One or two place markers are moved down the queue string to a point beside the beginning of the desired passage. One place marker can be taken to mean the passage is on the left page and two place markers can mean it is on the right page. The reverse system of notation could be adopted, as long as one remains consistent.

The place markers may be flat paper or flat plastic members or they may be moveable beads. A ring between the anchor and the top of the string allows a plurality of strings to be included on a single bookmark.

Other beads, preferably of the ring type, (reference markers or "wells") may be included on a multiple queue string marker for indicating subjects of particular interest.

A stop on the bottom end of the string keeps the place markers and reference markers on the string. To signal subject matter, one or more reference markers may be moved all the way down the string to the stop, where they are visible when the book is closed. Queue strings with visible reference markers can be differentiated from those with no (or a different number of) reference markers. One visible reference marker may mark principal passages which directly concern the main subject. Two visible reference markers may mark secondary passages which support the main subject. Three visible reference markers may be used to mark passages which contain arguments or points that are contrary to the main subject. Other reference systems may be devised.

FEATURES AND ADVANTAGES

An object of this invention is to provide a bookmark which has moveable means for marking one's place on a particular page.

Another object is to provide a bookmark which has moveable means for signalling the subject matter of marked passages.

Yet another object is to provide a bookmark which has multiple strings, in order to allow a plurality of passages to be marked.

A further object is to disclose a bookmark which has anchor means for keeping the apparatus in place during use. For example, there may be times when no strings are in use as markers. The anchors disclosed herein will still keep the bookmark available for ready use.

Another object is to provide an apparatus which is easy to use, attractive in appearance and suitable for mass production at relatively low cost.

Other novel features which are characteristic of the invention, as to organization and method of operation, together with further objects and advantages thereof will be better understood from the following description considered in connection with the accompanying drawing in which a preferred embodiment of the invention is illustrated by way of example. It is to be expressly understood, however, that the drawing is for the purpose of illustration and description only and is not intended as a definition of the limits of the invention.

Certain terminology and derivations thereof may be used in the following description for convenience in reference only and will not be limiting. For example, the words "upwardly," "downwardly," "leftwardly," and "rightwardly" will refer to directions in the drawings to which reference is made. The words "inwardly"

and "outwardly" will refer to directions toward and away from, respectively, the geometric center of a device and designated parts thereof.

DRAWING REFERENCE NUMERALS

Figure 2:
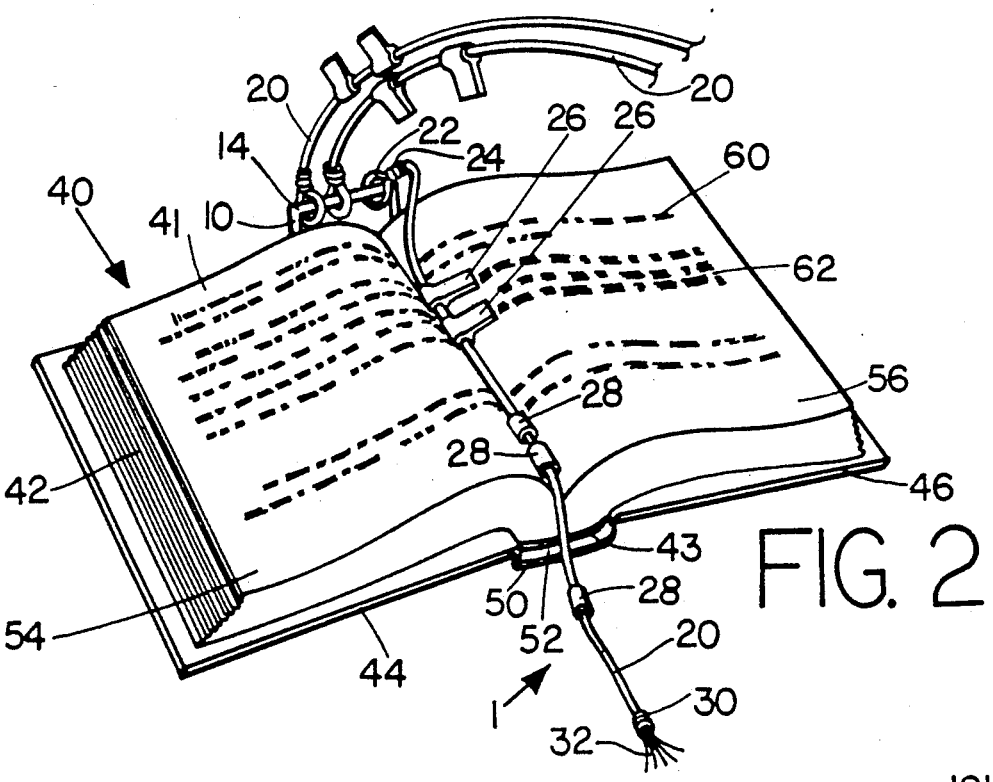
FIG. 2 is a broken perspective view of the bookmark of FIG. 1 illustrating its use in a book environment.

1 bookmark
4 anchor of 1
6 leg of 4, inner
8 leg of 4, outer
10 D-ring of 1
12 gap in 10
14 beam of 10
20 string of 1
22 loop of 20
24 clasp of 20, loop-forming
26 place marker of 20
28 reference marker of 20
30 stop of 20
32 free end of 20
40 book
41 body of 40
42 leaves of 41
43 cheesecloth super of 41
44 cover of 40, front
46 cover of 40, rear
50 spine between 44 and 46
52 free space between 43 and 50
54 page of 42, left hand
56 page of 42, right hand
60 text
62 marked passage of 60
101 bookmark
104 anchor of 101
105 hook portion of 104
107 loop portion of 104
110 O-ring of 101
111 thread of 105 and 110
120 string of 101
122 loop of 120
124 clasp of 120, loop-forming
126 place marker of 120
130 stop of 120
132 free end of 120
140 book
150 spine of 140

DESCRIPTION OF A PREFERRED EMBODIMENT

Figure 1:
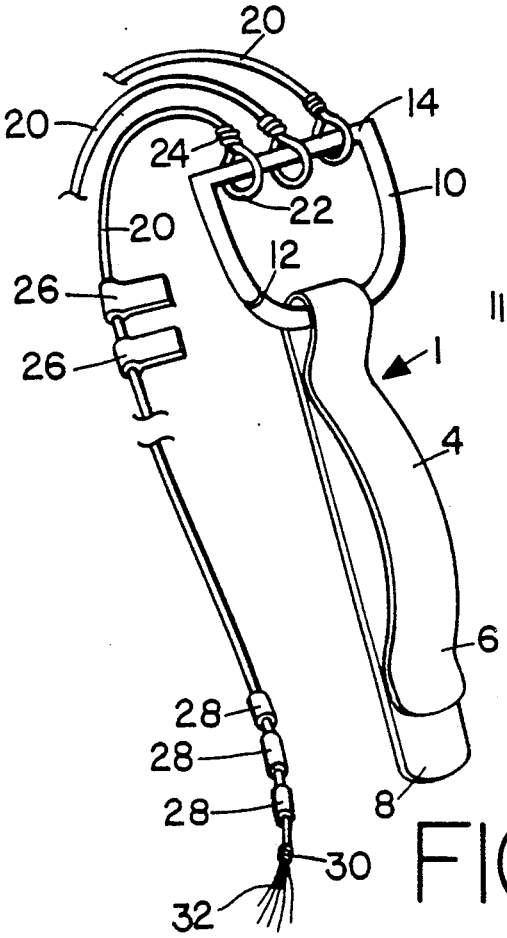
FIG. 1 is a broken perspective view of the bookmark apparatus of the present invention.

Referring to FIG. 1, there is illustrated therein a preferred embodiment of the bookmark apparatus 1 of this invention. Bookmark 1 generally comprises an anchor 4, a D-ring 10, and a plurality of strings 20.

The anchor for hardcover books preferably is a U-shaped piece of spring plastic or steel. Anchor 4 has a pair of mutually opposed legs, inner 6 and outer 8. The anchor is threaded through the D-ring 10.

At least one string 20, and preferably a plurality of strings 20, is also attached to the D-ring. Each string has a loop 22 formed by a clasp or knot 24. The loops can be threaded on and off the D-ring through a gap 12 provided for that purpose. Thus, extra strings can be added or removed, as the user's needs change. The straight upper beam 14 of the ring provides a tangle-free place for resting a multiplicity of strings 20 in serial order.

Each string has two moveable place markers 26, which may be in the form of planar flags, as shown in FIG. 1, or may be beads, as shown in the alternate embodiment of FIG. 3, discussed below.

Below the place markers, the string carries one or more, preferably three, reference markers 28. The markers 26, 28 are held on the string by a stop or knot 30 affixed to the free end 32 of the string.

Turning to FIG. 2, the use of the bookmark apparatus in the environment of a hardcover book 40 will be explained. The body 41 of the book is formed of leaves 42 which are assembled in signature groups sewed together along the back edges of the latter, which back edges are then covered by a cheesecloth super 43. A sheet of cloth covers the two coverboards, forming front cover 44 and rear cover 46. The covers 44, 46 are separated by a loose central portion of the cloth, which central portion is referred to as the spine 50. When the book is opened, as in FIG. 2, a free space 52 opens up between the body 41 and the spine 50. The inner leg 6 of the anchor 4 may be inserted into this free space, whereby the clamping action of the two legs 6, 8 of the anchor securely holds the bookmark 1 in place for ready use.

Each leaf 42 of the book 40 has two pages containing printed text 60. The left-hand (from the point of view of an open book 40) page 54 of one leaf and the right-hand page 56 of the succeeding leaf are visible. When the book is closed, any string 20 that was previously inserted between adjacent leaves will expose its free end 32, generally marking the right and left pages 54, 56 in the traditional manner.

To additionally mark for later perusal a passage 62 of the text on a specific page, however, one pulls one or two place markers 26 from their resting place against the loop clasp 24 down to the point where the desired passage begins. One place marker down (the other remaining up at the clasp) means that the passage begins opposite the marker is on the left-hand page 54. Two place markers down, as shown in FIG. 2, means that the marked passage 62 (shown in bold) begins opposite the marker on the right-hand page 56.

To signal the general subject matter of the marked passage, one can pull one, two, or three reference markers 28, here shown as beads. Unused reference markers are stored in the bottom margin of the printed pages 54, 56 and are out of sight when the book 40 is closed.

Thus, in the position shown in FIG. 2, only one reference marker 28 will be visible when the book is closed, indicating that the main subject of interest is marked with its particular string 20, according to the preferred reference system discussed above.

Figure 3:
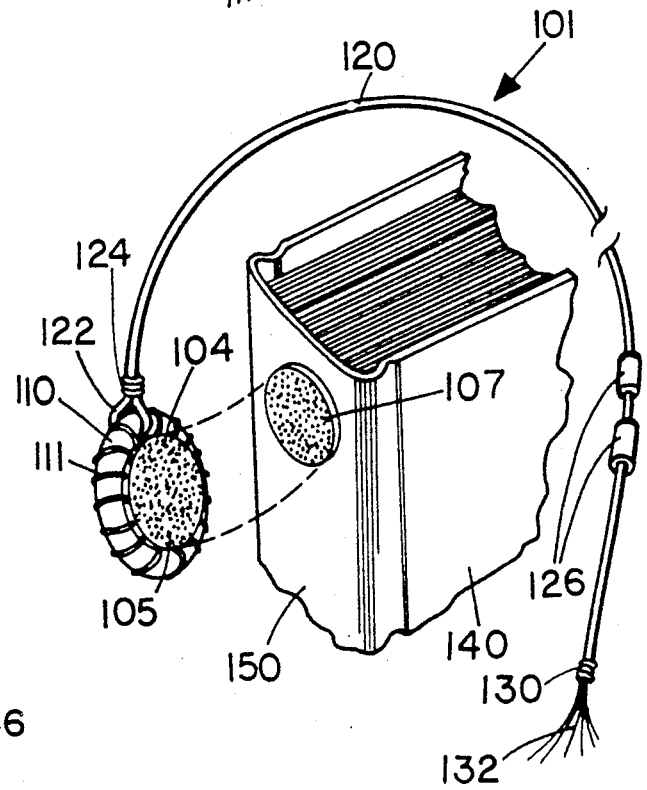
FIG. 3 is a broken perspective view of an alternate embodiment of the invention in a book environment.

An alternate embodiment of the invention, bookmark apparatus 101 is shown in FIG. 3. It is to be noted that, for convenience, the last two positions of the reference numerals of the alternate embodiment of the invention duplicate those of the reference numerals of the embodiment of FIG. 1 where they refer to corresponding or equivalent parts.

Bookmark 101 generally comprises an anchor 104, an O-ring 110, and a plurality of strings 120. Paperback books, as well as some hardcover books, do not have a loose spine covering a free space. The anchor for paperback books, therefore, preferably comprises hook portion 105 and loop portion 107 of VELCRO brand fastener material. Loop portion 107 may be affixed to the spine 150 of the book 140, typically by removing a release backing which covers an adhesive layer on the lower surface of the material. The hook portion 104 may be affixed to the O-ring by threads 111, or by glue, heat bond or the like. Obviously, the hook and loop portions could be reversed in position.

Preferably one string 120, but perhaps a plurality of strings, is also attached to the O-ring. Each string has a loop 122 formed by a clasp or knot 124. Each string has two moveable place markers 126, which may be in the form of planar flags, as shown in FIG. 1 discussed above, or may be beads, as shown in the alternate embodiment of FIG. 3. The markers 126 are held on the string by a stop or knot 130 affixed to the free end 132 of the string.

Insofar as paperback books tend to be shorter in length and often (but not always) contain lighter reading material, it is envisioned that only two moveable markers will be affixed to the single string 120 of a paperback bookmark 101, and that these will be used as place markers 126 in the manner discussed above. However, additional markers could be added for use as reference markers and additional strings could be strung on the anchor (not illustrated) of a paperback bookmark.

While the above provides a full and complete disclosure of the preferred embodiments of this invention, various modifications, alternate constructions, and equivalents may be employed without departing from the true spirit and scope of the invention. Such changes might involve alternate materials, components, structural arrangements, sizes, operational features or the like. Therefore, the above description and illustrations should not be construed as limiting the scope of the invention which is defined by the appended claims.

I claim:

1. Bookmark apparatus including:

a plurality of strings;

two moveable place markers on each string;

at least one moveable reference marker bead on each string; and anchor means interconnected with the strings for securing the strings to the book.

2. The apparatus of claim 1 further including:

a ring interconnecting the strings and the anchor means, the ring having a gap for adding and removing strings.

3. The apparatus of claim 2 further including:

a stop on a first end of each string, which stop holds the place markers and reference marker bead on the string; and a clasp on a second end of each string, which clasp forms the second end into a loop for connecting the string onto the ring through the gap.

4. The apparatus of claim 3 wherein:

the anchor means comprises a U-shaped clamp having two interconnected and mutually opposed legs, the ring being engaged between the two legs at their point of interconnection.

5. The apparatus of claim 4 wherein:

the ring is a D-ring; and the place markers are planar flags.

6. Bookmark apparatus including:

at least one string;

two moveable beads on the at least one string;

a stop on a first end of the at least one string, which stop holds the moveable beads on the string;

hook and loop fastener material; and means for interconnecting the hook and loop fastener material with the at least one string at a second end of the latter.

7. The apparatus of claim 6 further including:

a ring onto which the at least one string and the hook and loop fastener material are fastened.

8. The apparatus of claim 7 wherein:

the ring is an O-ring;

and further including: a clasp on the second end of the at least one string, which clasp forms the second end into a loop for connecting the string onto the ring.

9. Bookmark apparatus including:

at least one string having a circular cross-section;

two moveable place markers on the at least one string;

a plurality of moveable reference marker beads on the at least one string; and anchor means interconnected with the at least one string for securing the at least one string to the book.

* * * * *